United States Patent [19]

Driscoll et al.

[11] Patent Number: 4,572,452

[45] Date of Patent: Feb. 25, 1986

[54] APPARATUS FOR SLITTING AND WINDING TAPE

[75] Inventors: John S. Driscoll, Huntley; Robert E. Palka, Morton Grove, both of Ill.

[73] Assignee: Illinois Carbon Products, Algonquin, Ill.

[21] Appl. No.: 674,231

[22] Filed: Nov. 21, 1984

[51] Int. Cl.[4] ..... B65H 35/02; B65H 19/04; B32B 3/04

[52] U.S. Cl. ..... 242/56.2; 242/56.6; 242/56.9; 156/259

[58] Field of Search ..... 242/56.2, 56.3, 56.4, 242/56.5, 56.7, 56.8, 56.9; 156/259, 505, 506, 157

[56] References Cited

U.S. PATENT DOCUMENTS

| | | | |
|---|---|---|---|
| 1,257,853 | 2/1918 | Hansen | 242/56.5 |
| 1,779,578 | 10/1930 | Andersen | 242/56.2 |
| 2,326,173 | 8/1943 | Russell | 242/56.4 |
| 2,660,221 | 11/1953 | Simpson | 156/506 |
| 4,033,521 | 7/1977 | Dee | 242/56.2 |
| 4,093,140 | 6/1978 | Matsunaga | 242/56.2 |
| 4,175,999 | 11/1979 | Schoettle et al. | 242/56.6 X |
| 4,201,352 | 5/1980 | Mudachy | 242/56.2 |
| 4,219,168 | 8/1980 | Lofstrom | 242/56.2 |
| 4,438,888 | 3/1984 | Seelinger | 242/56.9 |

FOREIGN PATENT DOCUMENTS

| | | | |
|---|---|---|---|
| 305679 | 12/1917 | Fed. Rep. of Germany | 242/56.5 |

*Primary Examiner*—Stuart S. Levy
*Assistant Examiner*—Lloyd D. Doigan
*Attorney, Agent, or Firm*—Ralph R. Rath

[57] ABSTRACT

A slitting and winding machine for tape includes a base (12) having a working surface (22) with a tape supply support (20) and a take-up mandrel assembly (80) at opposite ends of the working surface, along with a cutter mechanism (54) between the mandrel assembly and the working surface. A pair of spaced rolls (40) of leader material and a roll (42) of connecting material are supported on the base on one side of the working surface and have adjacent edges overlapping to be drawn over the tape and replace a segment that is previously removed. The mechanism cuts the wide tape into narrow strips and alternate strips are directed across specially designed guide rollers (100) toward respective mandrels of the mandrel assembly. The cutter mechanism includes a grooved roller (60) and a cutter blade support bar (68) that is designed for quick change of cutter blades.

6 Claims, 5 Drawing Figures

APPARATUS FOR SLITTING AND WINDING TAPE

TECHNICAL FIELD

The present invention relates generally to machinery for assembling narrow strips of tape onto support cores and, more particularly, to a slitting and winding apparatus for converting a wide supply of endless tape into a plurality of individual narrow strips supported on cores.

BACKGROUND PRIOR ART

In machines to which the present invention is directed, a relatively wide web of tape material is slit into a plurality of narrow strips which are respectively wound into rolls on individual cores. This type of machine has been utilized for many years for packaging of various types of tapes, such as electrical tape, typewriter ribbons, pressure-sensative tapes, and lift-off tapes that are normally used in conjunction with correction of errors of electronic typewriters.

More specifically, the present invention is directed towards a machine wherein a pair of rotating mandrels are utilized to support a plurality of axially-spaced cores and an endless wide supply of tape, such as lift-off tape, is delivered to the machine, is slit into a large group of very narrow strips, and alternating narrow strips of tape are then automatically wound onto the cores supported on the respective mandrels.

Various manufacturers have developed machinery of this type, and exemplary units are offered by John Dusenbery Company, Inc. as a Model 623BT/TR Duplex Turret Slitter. This machine, while satisfactory for its intended purpose, is very expensive, requires considerable maintenance and must provide an accurate synchronized drive for the various driven components.

In packaging tapes of this type, the overall appearance of the final product is not only important from a marketing standpoint, but is also important from a performance standpoint. Two of the more important criteria are uniformity in density of the wrap and evenness of the edges. Uneven edges detract from the appearance and may impede proper feeding in a typewriter, while non-uniform density will change the size of the roll which may also create problems during use.

Thus, there remains a need for a slitting and winding machine that is capable of repeated uniformity in density and consistency, as well as alignment of lateral edges of the tape on the core and one which can be manufactured at minimum cost and can subsequently be maintained substantially free of any other costs.

SUMMARY OF THE INVENTION

According to the present invention, a slitting and winding machine has been developed which is extremely compact in nature, inexpensive to construct, has a minimum number of driven parts to minimize maintenance requirements, and can easily be operated by one person. The machine is designed such that a very sharp cut is developed in the slitting operation, the narrow strips of tape have opposite edges accurately aligned to provide a uniform package, and the rolls of tape have consistent uniformity in density and overall configuration.

According to the present invention, the machine includes a base that has a support for a large roll of supply tape at one end and a pair of driven take-up mandrels at an opposite end, with a working surface defined on the base adjacent the one end, and a guide mechanism between the tape supply roll and the take-up mandrels. A cutting mechanism is incorporated into the system between the table working surface and the take-up mandrels and includes a grooved roller that cooperates with a plurality of cutter blades that are held in a common fixed support, which can easily be adjusted and removed and replaced.

The guide mechanism also incorporates. a pair of one-piece guide rollers that are machined to produce enlarged circular segments spaced by reduced circular segments, with the lateral dimensions of the segments being substantially equal to the width of the narrow strips of tape that are produced from the supply roll by the cutting mechanism. The guide rollers are positioned an equal dimension from the respective take-up mandrels and the take-up mandrels are positively driven by a suitable supply source so that the tape is drawn through the cutter mechanism onto the cores that are supported on the mandrels.

According to one aspect of the present invention, the base or table has an upright support adjacent one side of the working surface, which has a pair of vertically-spaced shafts that respectively receive a pair of spaced rolls of leader material on one shaft and an intermediate roll of connecting material on the other shaft so that the three rolls can simultaneously be drawn across the work surface and inserted into the supply roll of tape by removal of a segment therefrom on the working surface.

According to a further aspect of the invention, the mechanism is positively driven and electronically controlled through a suitable counter mechanism with the controls being located in an easily accessible position adjacent the mandrel end of the machine so that one operator can observe the counter and operate the entire machine. The machine drive can be interrupted as desired and the mandrels removed and replaced with new mandrels. According to a further aspect of the invention, the mandrels are preferably arranged in tandem pairs on a pair of spaced pivots so that a first pair of mandrels can be winding a tape thereon while the second pair of mandrels can be removed completed packages and replaced with new cores for subsequent operation.

BRIEF DESCRIPTION OF SEVERAL VIEWS OF DRAWINGS

DETAILED DESCRIPTION

Figure 1:
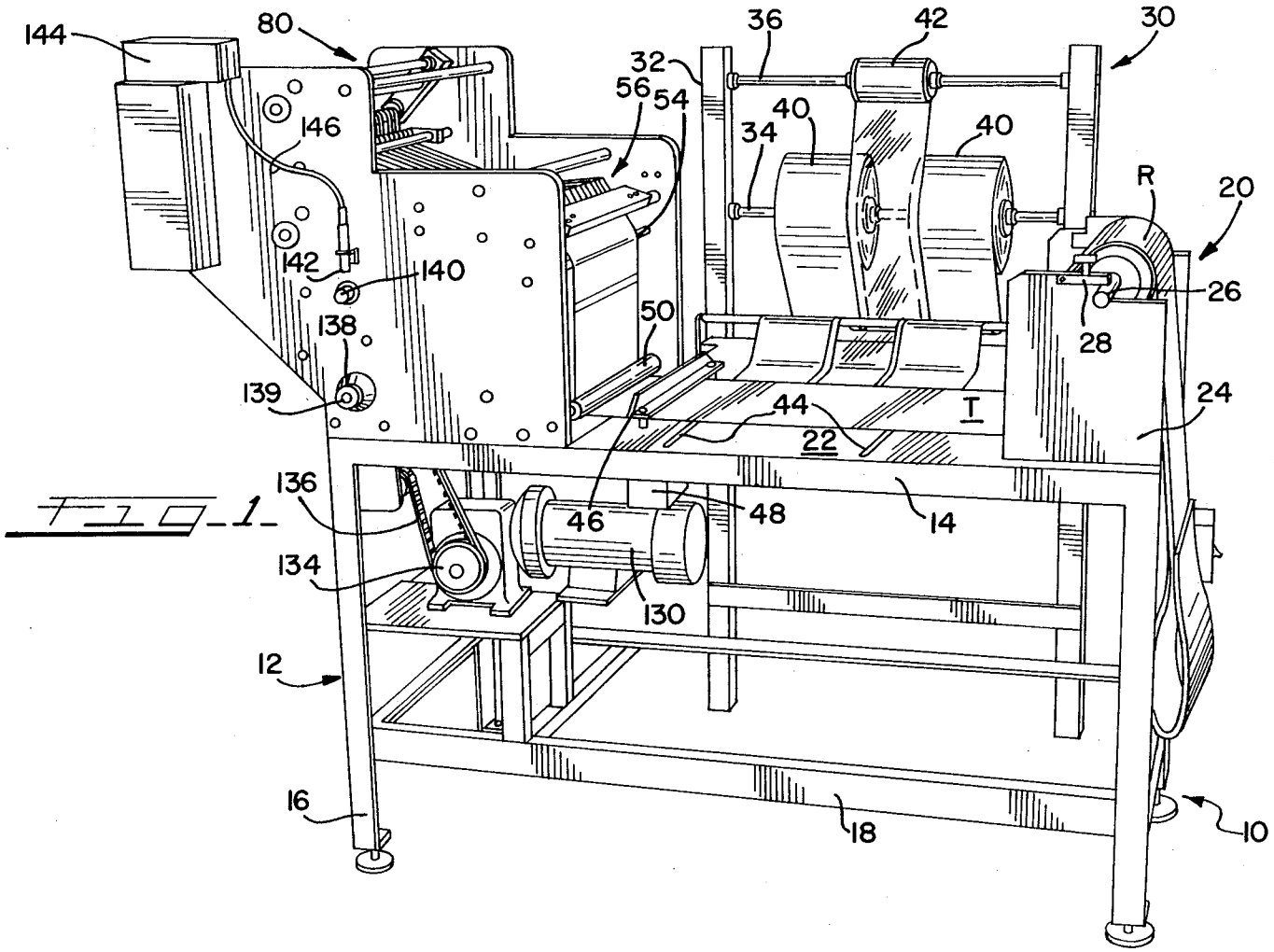
FIG. 1 is a perspective view of the slitting and winding machine constructed in accordance with the teachings of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings discloses a winding and slitting apparatus for packaging tapes onto individual cores and is generally designated by reference numeral 10. The machine 10 includes a base 12 that consists of a generally flat upper horizontal surface 14 that is supported on a plurality of legs 16 interconnected by a plurality of brace members 18. The base 12 has a support mechanism 20 at one end thereof located adjacent a working surface 22 defined on the upper surface 14 and the support 20 includes a pair of spaced uprights 24 that are adapted to support a shaft 26, which is releasably retained by clamps 28 and supports a roll of tape R.

A leader supply mechanism 30 is located on the base 12 adjacent one side of the working surface 22 and includes a pair of spaced uprights 32 that have first and second vertically-spaced shafts 34 and 36 extending therebetween. The spaced shafts 34 and 36 are adapted to respectively support leader material and connecting material. Thus, shaft 34 is designed to have a pair of spaced rolls of leader material 40 freely rotatable thereon and shaft 36 has a roll of connecting material or adhesive tape 42, such as an adhesive strip 42, freely rotatable thereon. It will be noted from an inspection of FIG. 1 that the opposite edges of the connecting material are positioned in overlapping relation to the adjacent edges of the respective rolls of leader material, for a purpose that will be described later.

The working surface is designed such that a segment of the supply of tape T can be removed on the working surface and replaced with a segment consisting of a pair of portions of leader material 40 interconnected by connecting material 42. Thus, working surface 22 has a pair of spaced slits 44 that extend parallel to each other and perpendicular to the path of the tape T. A clamping member 46 is positioned on the working surface adjacent the leading edge of the tape T. The clamping member consists of a bar that extends the entire width of the tape T and is vertically reciprocated through suitable mechanism, such as a pneumatic cylinder 48. A pair of guide rollers 50 (only one being shown) are positioned on opposite ends of the working surface to direct the tape T across the surface 22 in close proximity thereto.

The tape T is directed from guide roller 50 generally upwardly across a guide bar or roller 54 to a cutting mechanism, generally designated by reference numeral 56. The cutting mechanism is shown in enlarged detail in FIG. 2 and consists of a grooved roll 60 that has opposite ends supported on spaced uprights 62 that form part of the base 12. The grooved roll 60 has a plurality of transversely-spaced, arcuate grooves 64, each adapted to receive a cutter blade 66 supported on a blade support 68. Blade support 68 is fixed to a support rod 70 that is supported on uprights 62, as more clearly shown in FIG. 2. Details of the blade support 68 will be described hereinafter.

The cutter means 56 separates the wide band of tape T into a plurality of relatively narrow strips of tape S which pass through a pair of pinch rollers 72 that are again freely rotatable on uprights 62. After the narrow strips of tape S pass through the gripping or pinch rollers 72, they are directed to a take-up mechanism 80.

Figure 3:
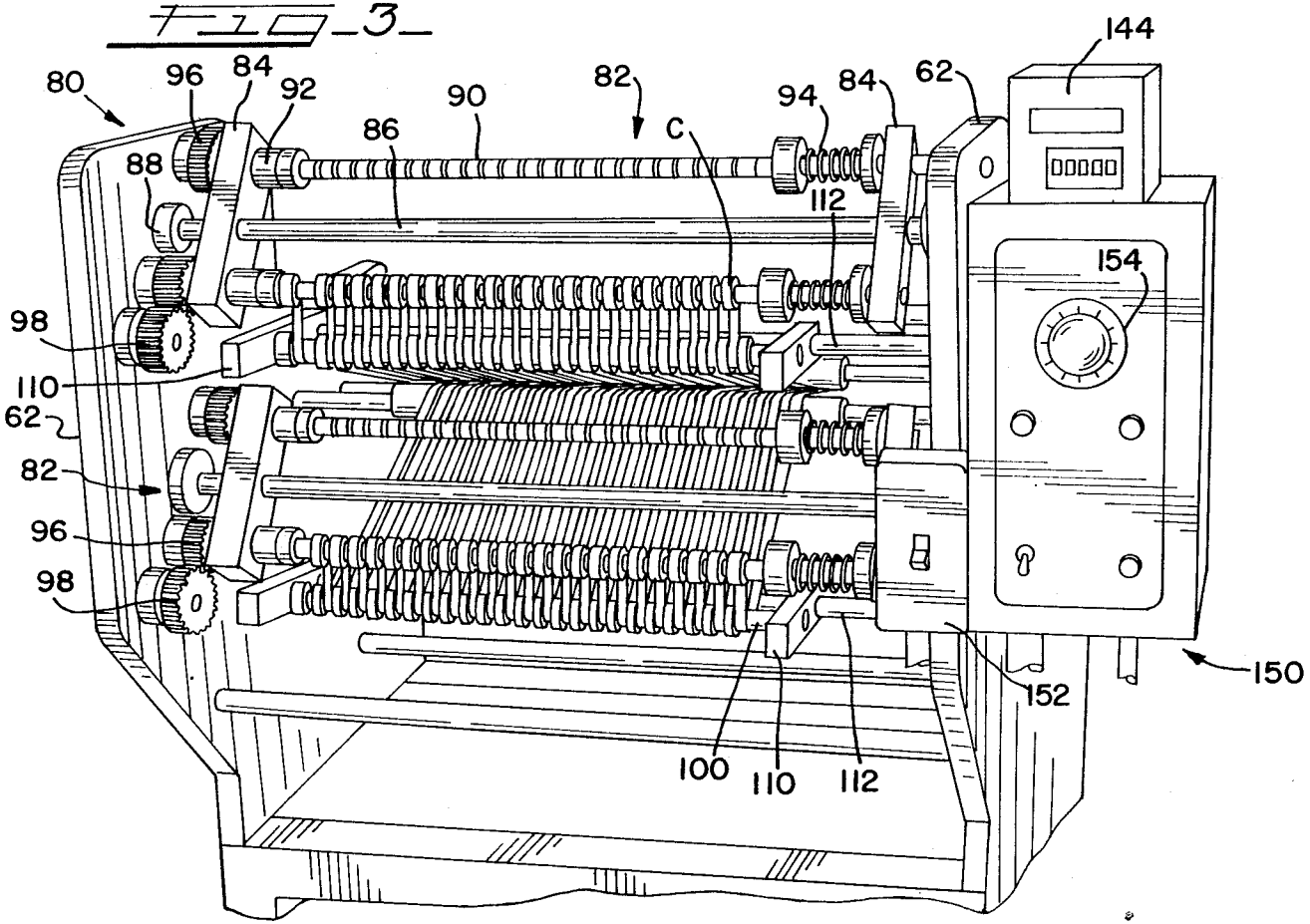
FIG. 3 is an enlarged fragmentary perspective view of the mandrel end of the machine.

The take-up mechanism 80 is located at the opposite end of the base between the spaced uprights 62 and is illustrated in detail in FIG. 3. This mechanism includes upper and lower identical mandrel assemblies 82, each of which include a pair of brackets 84 that have intermediate portions fixed to a shaft 86 which is journaled in suitable bearings or collars 88 on the uprights 62. A pair of mandrels 90 are supported at opposite ends of the brackets or supports 84 through collars 92, one of which is spring-biased through a spring 94. A rotatable gear 96 is secured to and rotates with each collar 92 at one end and is adapted to be positioned in mesh with a drive gear 98 rotatably supported on one upright 62. Thus, the respective mandrels 90 can be released from the assembly by compressing the spring 94 and replaced with a new mandrel. Each mandrel assembly is rotatable about support shaft 86 and is held in the position illustrated in FIG. 3 by a pin extending through an opening (not shown) in upright 62 and support bracket 84.

According to a primary aspect of the present invention, a specially designed guide roller 100 is positioned in close proximity to and equally spaced from each of the mandrels 90 when they are in driving relation with drive gears 98. The guide roller 100 is shown in enlarged perspective view in FIG. 4 and includes a metallic shaft 102, preferably formed from brass that has reduced support stubs 104 extending from opposite ends, which can be integral or formed separately.

The metallic shaft 102 has an initial diameter at least equal to the final diameter of the finished roll of lift-off tape and has a plurality of equally spaced segments removed by machining to produce enlarged circular segments 106 alternating with reduced circular segments 108 that define circular guide slots for the respective strips of tape S directed to the respective mandrels 90.

Each guide roller 100 (FIG. 3) is preferably supported between a pair of brackets 110 extending from a support shaft 112 supported on uprights 62. As shown in FIG. 3, the guide rollers 100 are positioned in close proximity to and below the mandrels 90 that support the cores C and are angularly adjustable on uprights 62, for a purpose that will be described later.

The one-piece machined metallic guide roller 100 has been formed to provide significantly more accurate transverse alignment than prior art-type guides including sleeves separated by spacers on a support shaft. The unitary machined guide roller has alternating enlarged and reduced circular segments that have a transverse dimension substantially equal and preferably exactly equal to the width of the strips of tape S to produce very accurate alignment of the edges of the strips S on the cores C, resulting in an attractive finished product that will easily feed through a typewriter.

Figures 4, 5:
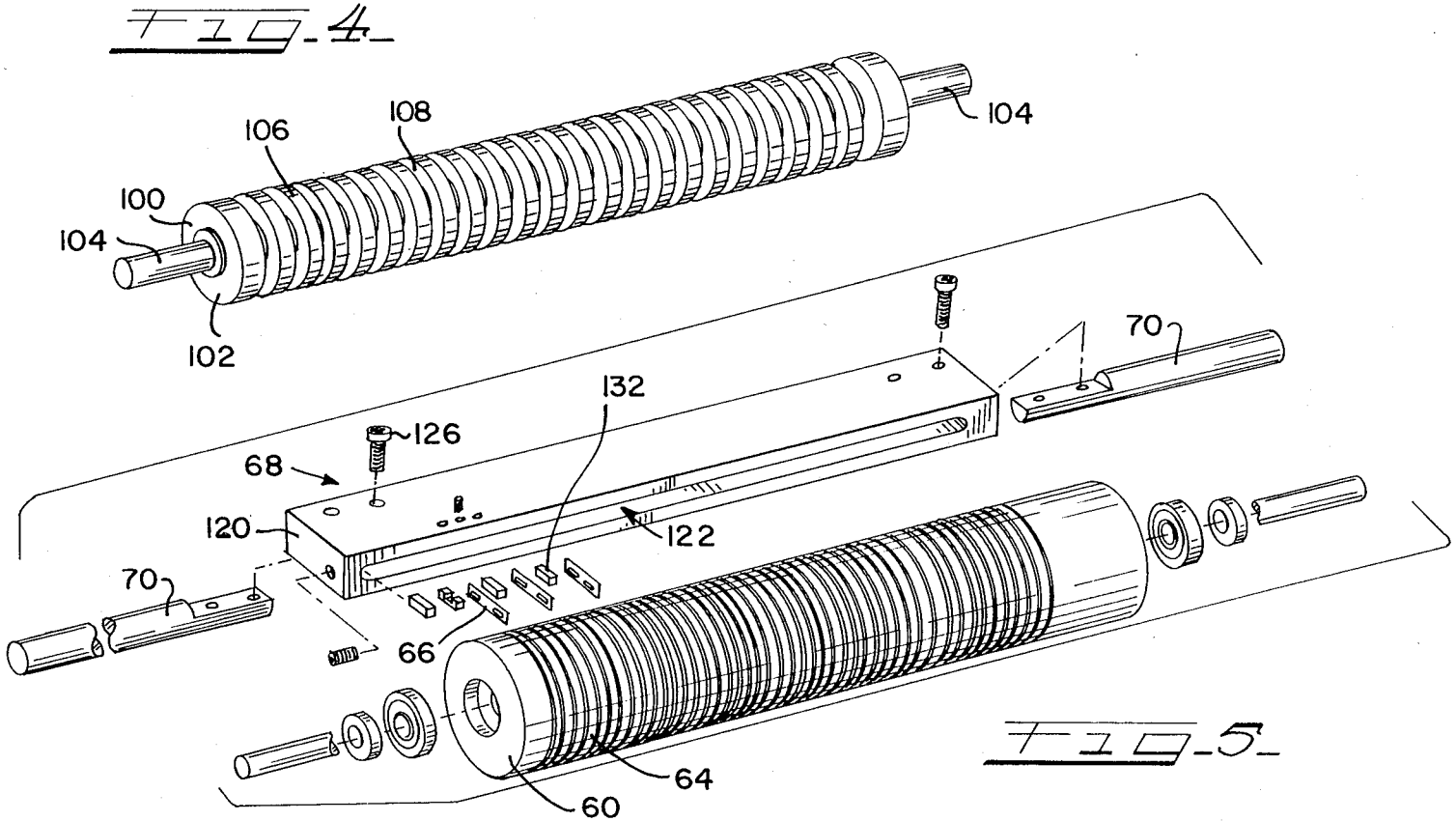
FIG. 4 is an enlarged perspective view of one guide roller incorporated into the machine; and, FIG. 5 is an exploded perspective view of the details of the cutting mechanism.

The cutter mechanism is also designed to provide a clear and even cut at all times usng razor blades that are guided in a grooved roller and are supported in a bar that allows quick replacement in a minimum period of time. As shown in FIG. 5, blade support includes an elongated bar 120 that has a slot 122 extending from one edge. Support bar 120 has stub stafts 124 that have flattened ends 125 connected to opposite ends through screws 126 and defined the shaft support 70. The stub shafts are received into openings in uprights 62 and may be held in angular oriented position with respect thereto by suitable means (not shown).

A plurality of razor blades or other flat cutting elements 66 are received into slot 122 and are located between adjacent spacers 132, all of which are held in position by a set screw. Suitable end spacers are provided to accurately position razor blades 66 with respect to grooves 64 in roller 60.

The cutter support bar 120 allows the operator to easily adjust the angular orientation of the elongated razor blade to produce a most efficient cut. For example, it has been found that having the elongated blades extending toward the trailing end of the wide band of tape and oriented at a small acute angle of approximately 15° with respect to the surface of the tape T will provide the cleanest cut using conventional razor blades guide in grooves.

Figure 2:
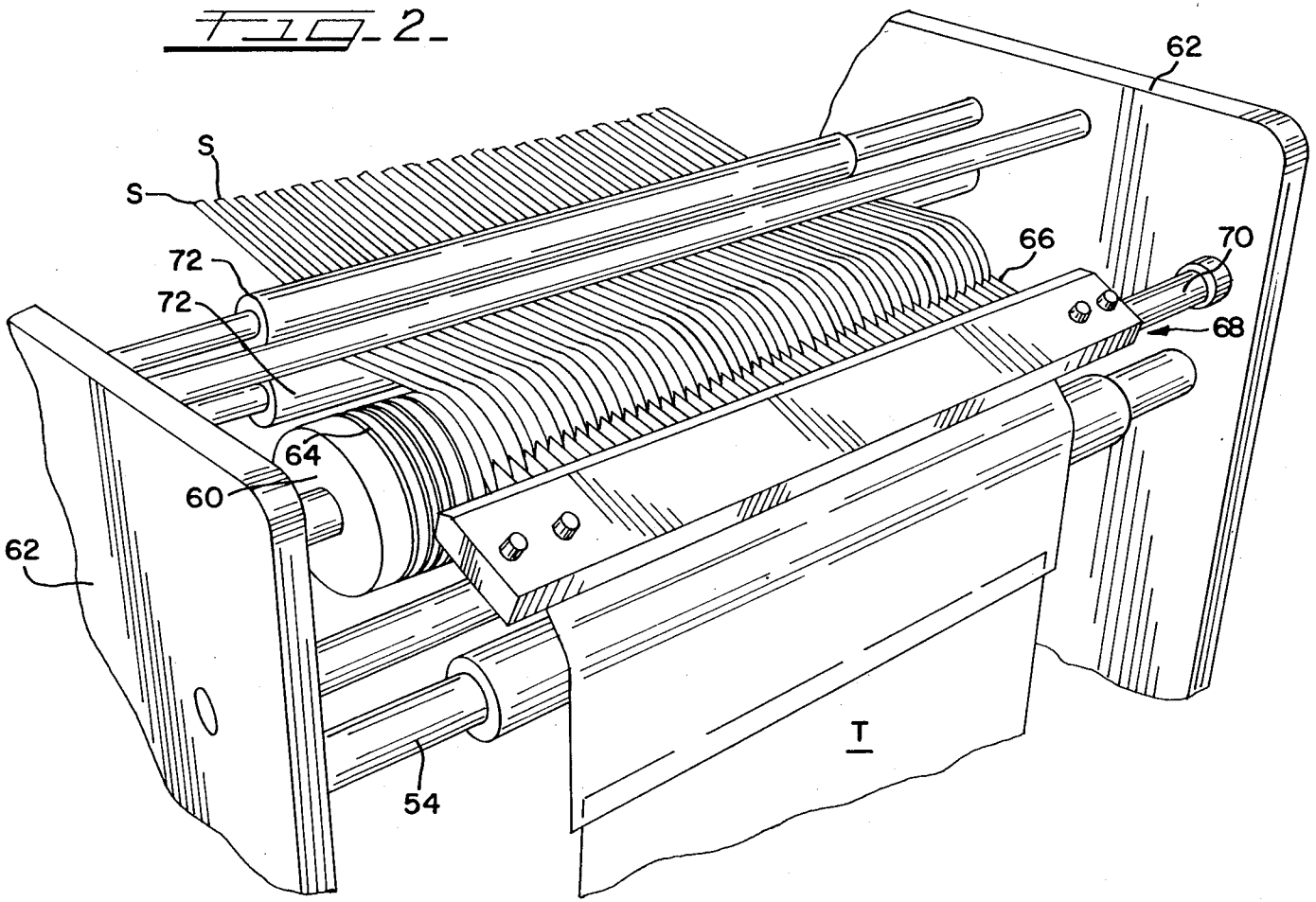
FIG. 2 is a fragmentary enlarged perspective view of the cutting mechanism and a portion of the guide means of the machine.

It should also be noted that the cutter mechanism 56 is fully exposed at a normal working height for an operator to be easily accessible for angular adjustment and replacement of the blades. Also, the path of movement of the wide band of tape is changed from a generally vertical direction to an inclined direction (FIG. 2) by the guide bar 54 before passing over the groove cutter roller 60 with the cutter blades positioned between the guide bar and the grooved roller to insure that the tape remains taut during the slitting action. To further insure that the tape remains taut in the cutting area, the tape is partially wrapped around the groove cutter roller 60 toward the pinch rollers 72 (FIG. 2).

According to a further aspect of the present invention, only the take-up mandrels 90 are positively driven so that the wide band of tape is pulled through the unit, including the cutter mechanism 56 which vastly simplifies the drive mechanism and elminates the need for synchronizing the speed of various driven shafts.

As shown in FIG. 1, the drive means includes a variable-speed drive motor 130 having an output shaft with a drive pulley 134 thereon. The drive pulley 134 is connected by a belt 136 to a main drive shaft 138 supported by bearings 139 in uprights 62. The opposite end of drive shaft 138 is connected by pulleys and a belt to the respective drive gears 98 which rotate on upright 62 and are in mesh with driven gears 96 that in turn rotate lower mandrels 90 (FIG. 3) and draw the tape from the supply of tape through the machine.

The drive mechanism also includes a driven shaft 140 supported on uprights 62 and driven by drive shaft 138 through the same belt (not shown) which drives gears 98. The shaft 140 has a sensor or probe 142 associated therewith that is connected to a counter 144 through a cable 146 and forms part of the control system 150 for drive motor 130. Control system 150 includes a main power switch 152 for controlling power to motor 130, an indicator on counter 144 and a variable reohstat control knob 154 and other emergency controls shown in FIG. 3.

The operation of the slitting and winding machine is believed to be apparent from the above description. An endless roll R of tape T is positioned on shaft 26 and shaft 26 is clamped on supports 24 by clamps 28. A pair of rolls 40 of leader material, such as adhesive tape, are positioned on shaft 34, while a roll 42 of connecting material is positioned on shaft 36. The tape T is then threaded under guide rolls 50, clamp bar 46 and through the various rollers and cutter mechanism 56 supported between uprights 62.

The operator is positioned in front of working surface 22 in FIG. 1 and cuts a segment of tape T with a cutter element (not shown) between slits 44, removing the segment. This cutter element may be similar to cutter element 66. The operator then grasps the two pieces of leader material interconnected with the connecting material and positions this segment on the working surface 22 in place of the removed segment of tape T with the remote edges of the leader material in overlapping relation with the tape on the working surface to reconnect the tape T.

Clamp bar 46 is then released and the operator moves to the end of the machine where the strips of tape had previously been connected to the respective cores on the two operating mandrels 90. The motor 130 is then energized and the tape T is withdrawn from supply roll R across working surface 22, through cutter means 56, pinch rollers 72 and across guide rolls 100 onto the cores C on mandrels 90. After a selected amount of tape has been wound on the cores C, the machine is stopped automatically or manually and a segment of leader material and connecting material are inserted on working surface 22, as described above. The motor is then energized and operated until the leading piece of leader material is on the cores and mandrels 90 and the machine is stopped, leaving the connecting material 42 exposed between the respective mandrels 90 and guide rollers 100. A bar (not shown) is then attached to the adhesive connecting material between the mandrel 90 and guide roller 100 and the individual strips are cut along the attached bar (not shown). The two mandrel assemblies are then rotated one half turn about support shafts 86 to disengage mandrels 90 with fully-wound cores from drive gears 98 and engage the other set of mandrels with empty cores with the drive gears. The free ends of the connecting material for each strip are then connected to the new empty cores and the operation is repeated.

As can be appreciated from the above description, the present invention provides an extremely simple compact machine which can accurately align the edges of strips of tape on cores at a uniform density and can easily be operated by one employee. The cutter blades are staple articles that can be acquired at a minimum cost and can quickly be replaced in a short period of time.

Since the tape is drawn through the machine by the take-up mechanism, there is no need for complicated synchronized drives between the various components and the maintenance costs are minimized because most parts are conventional components.

We claim:

1. Apparatus for packaging lift-off tapes having leader segments into rolls on cores from an endless supply of tape, comprising a base having a rotatable supply shaft for supporting said endless supply of tape, said base having a working surface aligned with said supply shaft, at least first and second spaced mandrels rotatably supported on an opposite end of said base and aligned with said working surface and said supply shaft, guide means between said working surface and said mandrels for guiding said supply of tape along a predetermined path, cutter means associated with said guide means for cutting said supply of tape longitudinally across its width into a plurality of narrow strips with said strips being separated into alternating groups respectively directed toward said first and second spaced mandrels, said guide means including first and second guide rollers respectively located in the path of movement of said first and second groups, each of said guide rollers including a one-piece unit rotatably supported at opposite ends and having alternating reduced circular segments with adjacent surfaces of respective enlarged circular segments having a spacing substantially equal to the width of a narrow strip to maintain accurate alignment for opposite edges of each narrow strip with respect to the cores on said mandrels, and leader supply means including an upstanding support having first and second vertically-spaced shafts extending generally parallel to said path with first and second rolls of leader material axially spaced on said first shaft and a roll of connecting material on said second shaft positioned between said first and second rolls of leader material and having overlapping edges therewith so that a portion of supply of tape can be severed on said working surface and replaced with spaced segments of leader material interconnected by connecting material.

2. Apparatus as defined in claim 1, in which said working surface has spaced parallel guide slits extending transversely of said path for receiving cutting elements to separate a segment of said endless supply of tape and clamp means for clamping said tape on said surface.

3. Apparatus as defined in claim 1, in which each of said guide rollers including a metallic shaft having an outer diameter at least equal to the final diameter of said rolls of tape on said mandrels and having portions removed to define said reduced circular segments.

4. Apparatus as defined in claim 1, in which said cutter means includes a rotatable grooved roller and a fixed blade support bar adjacent said rotatable grooved roller and having an elongated blade-receiving slot, a plurality of blades and intermediate spacers received into said slot and clamping means for clamping said blades and intermediate spacers in said slots with the blades aligned and extending into grooves on said rotatable grooved roller.

5. Apparatus for assembling tape onto support cores including a base having a working surfaces thereon and with a tape supply support on said base at one end of said working surface supporting an endless supply of tape; first and second guide members on said base on opposite ends of said working surfaces to guide said tape along a path across said working surface, cutter means on said base aligned ith said path, said cutter means including a rotatable groove roller and a fixed blade support bar having a plurality of blades extending therefrom and received into respective grooves for severing said tape into a plurality of narrow strips; at least two spaced mandrels rotatably supported on said base and each adapted to support a plurality of support cores in axially spaced relation; guide means on said base between said cutter means and said mandrels for guiding alternate narrow strips toward respective mandrels, said guide means including first and second continuous guide shafts respectively equally spaced from respective mandrels and each having alternating enlarged circular segments and reduced circular segments with said segments each having an axial dimension substantially equal to the width of said narrow strips of tape for maintaining accurate transverse alignment of alternate strips ith respect to said support cores on respective mandrels; and common drive means for rotating said mandrels to draw said tape across said working surface, through said cutter means to form said narrow strips of tape and onto said support cores on said mandrels, said base having an upright support on one side of said working surface with first and second spaced support shafts on said upright support, said first shaft supporting a roll of connecting material and said second shaft supporting a pair of axially-spaced rolls of leader material having adjacent edges in overlapping relation with opposite edges of said connecting material so that a segment of said tape can be severed on said working surface and replaced with two spaced segments of leader material interconnected by a segment of connecting material with remote edges of respective segments of leader material in overlapping connecting relation with respect to severed edges of said tape.

6. Apparatus as defined in claim 5, in which said working surface has a pair of spaced slits extending transversely of said path for receiving a cutting element to sever said segment of said tape, said spaced slits having a spacing less than the combined width of said segments of leader material and connecting material.

* * * * *